US009697806B2

(12) United States Patent
Lee et al.

(10) Patent No.: US 9,697,806 B2
(45) Date of Patent: Jul. 4, 2017

(54) SELF-REFRESH CONTROL METHOD, SINK DEVICE THEREOF AND DISPLAY SYSTEM THEREOF

(71) Applicant: NOVATEK Microelectronics Corp., Hsin-Chu (TW)

(72) Inventors: Chia-Hao Lee, Hsinchu County (TW); Yu-Hsuan Huang, Hsinchu County (TW); Chueh-An Tsai, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 547 days.

(21) Appl. No.: 14/272,507

(22) Filed: May 8, 2014

(65) Prior Publication Data

US 2015/0325166 A1 Nov. 12, 2015

(51) Int. Cl.
*G09G 5/393* (2006.01)
*G09G 3/20* (2006.01)

(52) U.S. Cl.
CPC ..... *G09G 5/393* (2013.01); *G09G 3/2092* (2013.01); *G09G 2310/061* (2013.01); *G09G 2320/0266* (2013.01); *G09G 2320/10* (2013.01)

(58) Field of Classification Search
CPC combination set(s) only.
See application file for complete search history.

(56) References Cited

U.S. PATENT DOCUMENTS

2013/0147822 A1 6/2013 Yu

*Primary Examiner* — Robin Mishler
(74) *Attorney, Agent, or Firm* — Winston Hsu

(57) ABSTRACT

A self-refresh control method for a display system includes receiving a frame from a video source of the display system; storing the frame in a storage module of the display system according to a writing timing sequence signal; accessing data stored in the storage module as a self-refresh frame according to a reading timing sequence, for outputting the self-refresh frame to a display device of the display system; and adjusting the reading timing sequence signal according to the writing timing sequence signal and the reading timing sequence signal.

10 Claims, 8 Drawing Sheets

SELF-REFRESH CONTROL METHOD, SINK DEVICE THEREOF AND DISPLAY SYSTEM THEREOF

BACKGROUND OF THE INVENTION

1. Field of the Invention

The present invention relates to a self-refresh control method, sink device thereof and display system thereof, and more particularly, to a self-refresh control method for preventing the first frame tearing, sink device thereof, and display system thereof.

2. Description of the Prior Art

In a display system with a function of panel self-refresh defined in the specifications such as eDP 1.3/1.4, the single frame update feature is supported for updating a frame of a plurality of frames. For example, when the display system operates in the panel self-refresh mode for reducing the power consumption, the display system also needs to update the clock shown on the panel. In such a condition, the display system needs to update a new frame once every minute.

However, the timing of updating the new frame is not synchronous with the timing of displaying the frame, which may result in the frame tearing issue and downgrade the user experience.

SUMMARY OF THE INVENTION

In order to solve the above problem, the present invention provides a self-refresh control method for preventing the frame tearing issue, sink device thereof and display system thereof.

The present invention discloses a self-refresh control method for a display system, comprising receiving a frame from a video source of the display system; storing the frame in a storage module of the display system according to a writing timing sequence signal; accessing data stored in the storage module as a self-refresh frame according to a reading timing sequence, for outputting the self-refresh frame to a display device of the display system; and adjusting the reading timing sequence signal according to the writing timing sequence signal and the reading timing sequence signal.

The present invention further discloses a sink device for a display system, comprising a selecting module, for selecting one of a video data signal and a self-refresh frame to a display device of the display system; a receiving module, for receiving the video data signal from a video source of the display system, outputting the video data signal to the selecting module and generating a writing timing sequence signal according to the video data signal; a storage module, for storing a frame of the video data signal as the self-refresh frame and outputting the self-refresh frame to the selecting module according to a reading control signal; a displaying timing generating module, for generating a reading timing sequence signal corresponding to the reading control signal and adjusting the reading timing sequence signal according to a blanking indicating signal and a line conflict signal; and a self-refreshing module, for generating the writing control signal and the reading control signal according to the writing timing sequence signal and the reading timing sequence signal, adjusting the reading timing sequence signal according to the writing timing sequence signal and the reading timing sequence signal via the blanking indicating signal and the line conflict signal.

The present invention further discloses a display system, comprising a video source, for generating a video data signal; a display device, for displaying an output signal; a sink device, comprising a selecting module, for selecting one of a video data signal and a self-refresh frame as the output signal; a receiving module, for receiving the video data signal, outputting the video data signal to the selecting module and generating a writing timing sequence signal according to the video data signal; a storage module, for storing a frame of the video data signal as the self-refresh frame and outputting the self-refresh frame to the selecting module according to a reading control signal; a displaying timing generating module, for generating a reading timing sequence signal corresponding to the reading control signal and adjusting the reading timing sequence signal according to a blanking indicating signal and a line conflict signal; and a self-refreshing module, for generating the writing control signal and the reading control signal according to the writing timing sequence signal and the reading timing sequence signal, adjusting the reading timing sequence signal according to the writing timing sequence signal and the reading timing sequence signal via the blanking indicating signal and the line conflict signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
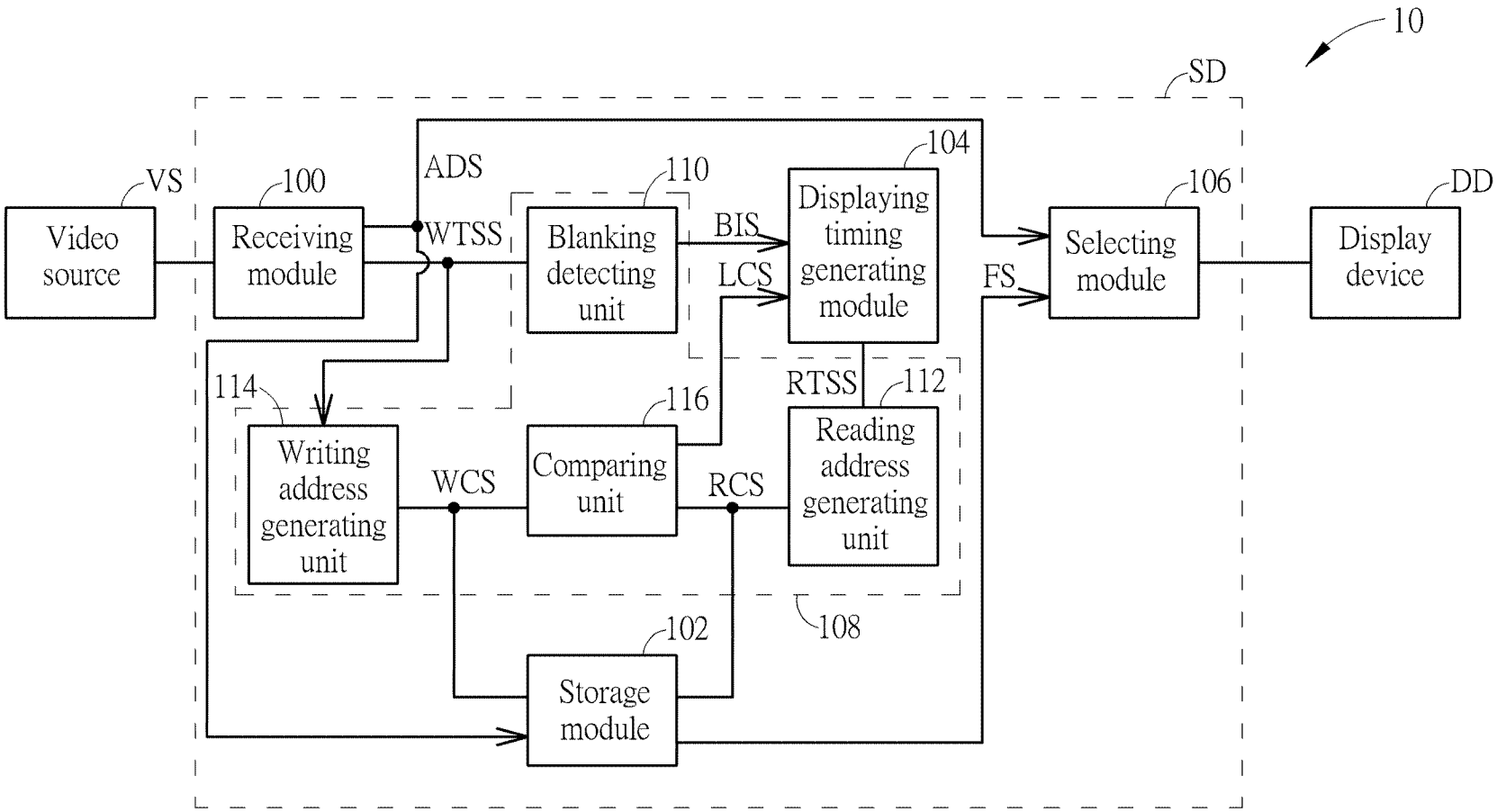
FIG. 1 is schematic diagram of a display system according to an example of the present invention.

Please refer to FIG. 1, which is a schematic diagram of a display system 10 according to an example of the present invention. The display system 10 is utilized for displaying a video data signal VDS from a video source VS. As shown in FIG. 1, the display system 10 comprises a video source VS, a sink device SD and a display device DD. The video source VS may be a video generator such as a Graphics Processing Unit (GPU), a hard disk, a memory and a video decoder and is utilized for generating a video data signal VDS. The sink device SD comprises a receiving module 100, a storage module 102, a displaying timing generating module 104, a selecting module 106 and a self-refreshing module 108. The receiving module 100 may be a display interface such as a Digital Visual Interface (DVI), a High-Definition Multimedia Interface (HDMI) and a Low-Voltage Differential Signaling (LVDS) and is utilized for receiving the video data signal VDS from the video source VS, outputting the video data signal VDS to the selecting module 106 and generating a writing timing sequence signal WTSS according to the video data signal VDS (e.g. according to the clock signal of the video data). The storage module 102 may be a frame buffer such as a memory and is utilized for storing line data of a self-refresh frame FS and outputting the line data of the self-refresh frame FS to the selecting module 106 according to a reading control signal RCS. Please note that, the minimum size required by the storage module 102 equals the size of a frame of the video data signal VDS. The displaying generating module 104 may be a clock generator such as a phase-locked loop (PLL) and a delay-locked loop (DLL) and is utilized for generating a reading timing sequence signal RTSS corresponding to the reading control signal RCS according to a blanking indicating signal BIS and a line conflict signal LCS. The selecting module 106 is utilized for selecting one of the video data signal VDS and the frame FS as the output signal OUT transmitted to a display device DD (e.g. a panel) according to a control signal CON. According to the control signal CON, the selecting module 106 outputs the video data signal VDS to the display device DD when the display system 10 operates in a normal mode and outputs the self-refresh frame FS to the display device DD when the display system 10 operates in a self-refresh mode for reducing the power consumption of the display system 10. When the display system 10 operates in the self-refresh mode, the self-refreshing module 108 generates the writing control signal WCS according to the writing timing sequence signal WTSS for updating the latest frame of the video data signal VDS to the storage module 102 and generates the reading control signal RCS according to the reading timing sequence signal RTSS for outputting the self-refresh frame FS to the selecting module 106. Noticeably, the self-refreshing module 108 adaptively adjusts the reading timing sequence signal RTSS according to the writing timing sequence signal WTSS via the blanking indicating signal BIS and the line conflict signal LCS transmitted to the displaying timing generating module 104, for avoiding the frame tearing issue.

In details, the self-refreshing module 108 comprises a blanking detecting unit 110, a reading address generating unit 112, a writing address generating unit 114 and a comparing unit 116. The blanking detecting unit 110 is utilized for detecting periods of the blanking intervals (e.g. the horizontal blanking) of the writing timing sequence signal WTSS and indicating the least blanking interval of the writing timing sequence signal WTSS to the displaying timing generating module 104 via the blanking indicating signal BIS. The blanking interval of the writing timing sequence signal WTSS is the interval between times of writing data of adjacent lines of the frame. The displaying timing generating module 104 can therefore adjust the blanking intervals of the reading timing sequence signal RTSS to be equaled to the least blanking interval of the writing timing sequence signal WTSS, for assuring that the frequency of the reading timing sequence signal RTSS is faster than that of the writing timing sequence signal WTSS. On the other hand, the reading address generating unit 112 generates the reading control signal RCS according to the reading timing sequence signal RTSS for instructing the timing sequence of reading the data of lines of the self-refresh frame FS. Similarly, the writing address generating unit 114 is utilized for generating the writing control signal WCS according to the writing timing sequence signal WTSS for instructing the timing sequence of writing data of lines of the latest frame in the video data signal VDS as that of the corresponded lines of the self-refresh frame FS. The comparing unit 116 is utilized for comparing the writing control signal WCS with the reading control signal RCS and accordingly generating the line conflict signal LCS. When both the writing control signal WCS and the reading control signal RCS simultaneously indicate the same line (i.e. when the data corresponding to single line of the self-refresh frame FS is read and wrote at the same time or the line conflict occurs, hereinafter), the comparing unit 116 instructs the displaying timing generating module 106 to adjust the reading timing sequence signal RTSS via the line conflict signal LCS, for stopping accessing the data of self-refresh frame FS. Via keeping the blanking interval of the reading timing sequence signal RTSS as the same with the least blanking interval of the writing timing sequence signal WTSS and adjusting the reading timing sequence signal RTSS when the line conflict occurs, the frame tearing issue can be avoided.

Figure 2:
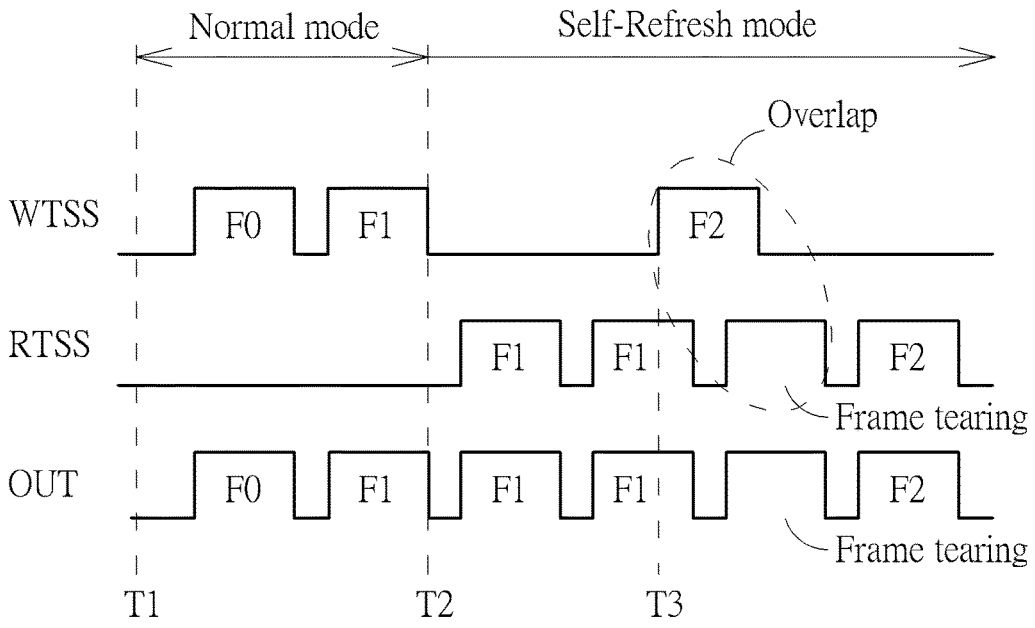
FIG. 2 is a timing diagram of related signals when the display system shown in FIG. 1 operates.

As to the detailed operations of the display system 10, please refer to the following examples. Please refer to FIG. 2, which is a timing diagram of related signals when the display system 10 operates. Noticeably, since the writing control signal WCS and the reading control signal RCS are corresponding to the writing timing sequence signal WTSS and the reading timing sequence signal RTSS, respectively, FIG. 2 only shows the writing timing sequence signal WTSS and the reading timing sequence signal RTSS for illustrations. As shown in FIG. 2, the display system 10 operates in the normal mode between the times T1 and T2, and the selecting module 106 outputs the frames F0 and F1 of the video data signal VDS as the output signal OUT. Next, the display system 10 enters the self-refresh mode at the time T2, and the selecting module 106 stores and outputs the self-refresh frame FS (i.e. the latest frame F1 of the video data signal VDS at the time T2) stored in the storage module 102. At a time T3, the receiving module 100 receives a frame F2 of the video data signal VDS and is required to update the self-refresh frame FS to be the frame F2. Since the time period of updating the self-refresh frame FS to be the frame F2 and that of accessing the original self-refresh frame FS (i.e. the frame F1) overlaps, the frame tearing issue may occur.

Figure 3A:
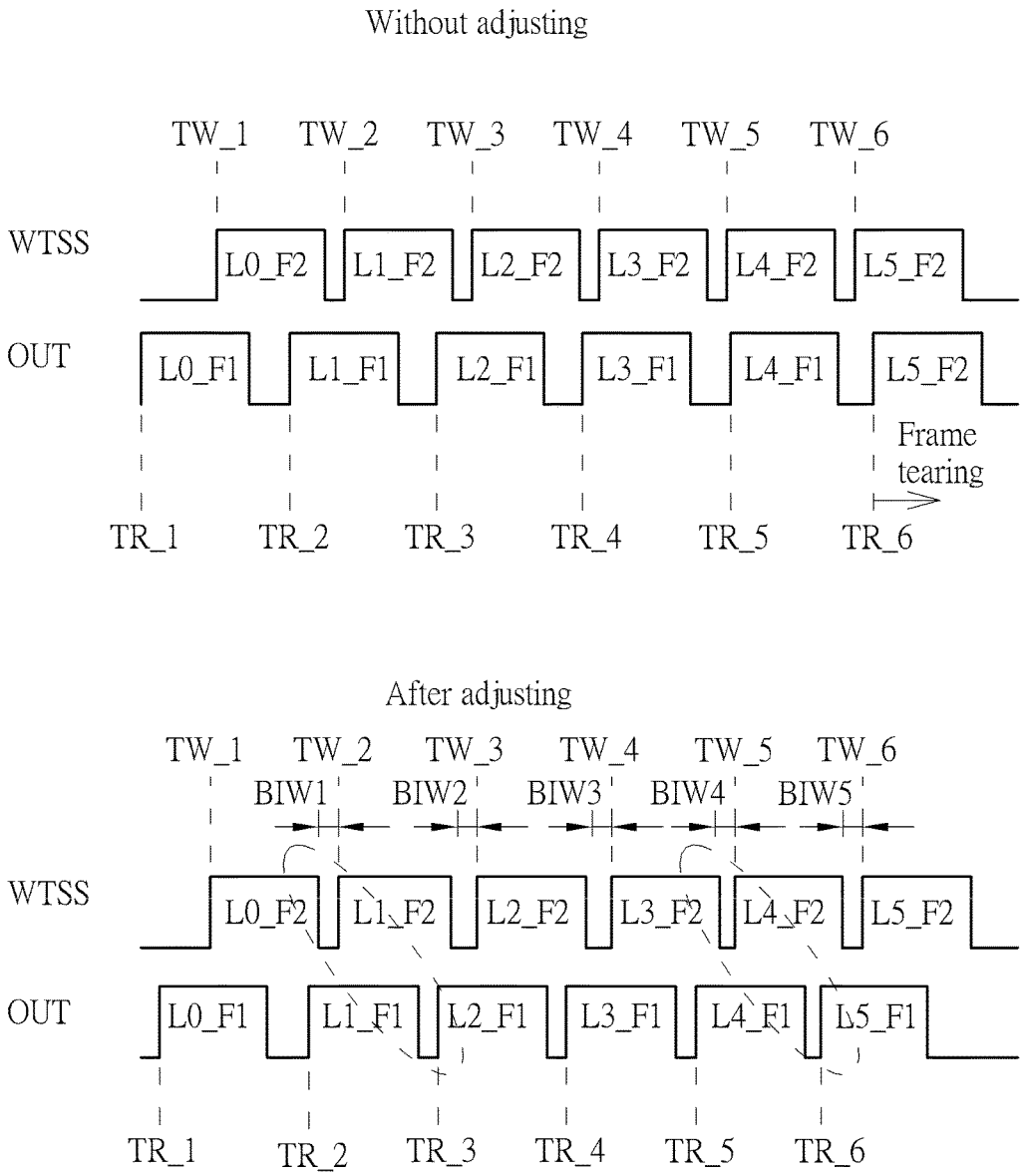
FIGS. 3A and 3B are timing diagrams of related signals when updating the frame in FIG. 2.

Please refer to FIG. 3A, which is a timing diagram of related signals when updating the frame F2 in FIG. 2. Noticeably, since the writing control signal WCS and the reading control signal RCS are corresponding to the writing timing sequence signal WTSS and the reading timing sequence signal RTSS, respectively, FIG. 2 only shows the writing timing sequence signal WTSS and the reading timing sequence signal RTSS for illustrations. As shown in FIG. 3A, the writing timing sequence signal WTSS instructs writing the line data L0_F2-L5_F2 of the frame F2 to the storage module 102 at times TW_1-TW_6, respectively, for replacing the line data L0_FS-L5_FS of the self-refresh frame FS with the line data L0_F2-L5_F2. On the other hand, the reading timing sequence signal RTSS instructs accessing the line data L0_FS-L5_FS of the self-refresh frame FS at times TR_1-TR_6, respectively. Since the times TR_1-TR_4 are earlier than the times TW_1-TW_5, line data L0_OUT-L4_OUT of the output signal OUT are line data L0_F1-L4_F1 of the frame F1 which is previously stored in the storage module 102. However, the frequency of the writing timing sequence signal WTSS is faster than that of the reading timing sequence signal RTSS in this example and the time TW_6 is earlier than the time TR_6. That is, the line data L5_OUT and the following line data of the output signal OUT are the line L5_F2 and the corresponding line data of the frame F2. The frame tearing issue appears if the reading timing sequence signal RTSS is not adaptively adjusted.

In such a condition, the blanking detecting unit 110 detects the blanking intervals of the writing timing sequence signal WTSS and indicates the least blanking interval of the writing signal WTSS to the displaying timing generating module 106, for adaptively adjusting the blanking intervals of the reading timing sequence signal RTSS to be equaled to the least blanking interval of the writing signal WTSS. As shown in FIG. 3A, the blanking detecting unit 110 first detects the time of a blanking interval BIW_1, and then indicates the blanking interval BIW_1 as the least blanking interval of the writing signal WTSS. The displaying timing generating module 106 therefore adjusts the blanking interval BIR_2 of the reading timing sequence signal RTSS to be equaled to the blanking interval BIW_1. Since the times of the following blanking intervals BIW_2 and BIW_3 are greater than the time of the blanking interval BIW_1, the least blanking interval of the writing timing sequence signal WTSS remains the blanking interval BIW_1 before the time TR_5 and the blanking intervals BIR_3 and BIR_4 are equaled to the blanking interval BIW_1. When detecting the time of a blanking interval BIW_5 and determining the time of the blanking interval BIW_4 is smaller than the blanking interval BIW_1 (the least blanking interval), the blanking detecting unit 110 updates the blanking interval BIW_4 to be the least blanking interval of the writing timing sequence signal WTSS and the displaying timing generating module 106 adjusts the blanking interval BIR_5 to be equaled to the blanking interval BIW_4, and so on. As a result, the reading timing sequence signal RTSS is always faster than the writing timing sequence signal WTSS; i.e. the times of accessing the data of the storage module 102 (e.g. the times TR_1-TR_5 in FIG. 3A) are always respectively earlier than the times of writing data to the storage module 102 (e.g. the times TW_1-TW_5 in FIG. 3A), the frame tearing issue therefore can be avoided.

Figure 3B:
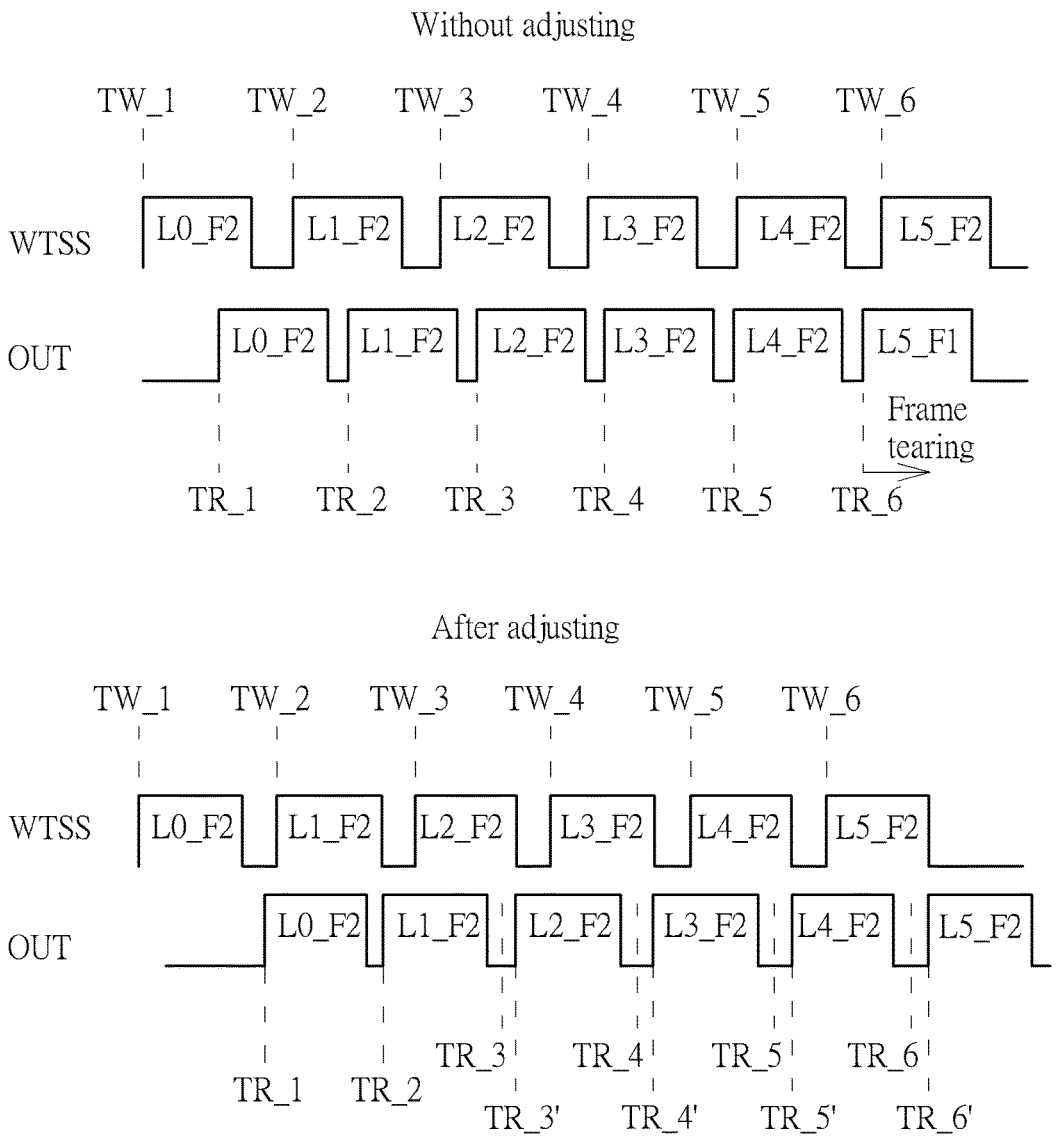

Please refer to FIG. 3B, which is a timing diagram of related signals when updating the frame F2 in FIG. 2. Noticeably, since the writing control signal WCS and the reading control signal RCS are corresponding to the writing timing sequence signal WTSS and the reading timing sequence signal RTSS, respectively, FIG. 2 only shows the writing timing sequence signal WTSS and the reading timing sequence signal RTSS for illustrations. Similar to FIG. 3A, the writing timing sequence signal WTSS instructs writing the line data L0_F2-L5_F2 of the frame F2 to the storage module 102 at times TW_1-TW_6, respectively, the reading timing sequence signal RTSS instructs accessing the line data L0_FS-L5_FS of the self-refresh frame FS at times TR_1-TR_6, respectively. Since the times TW_1-TW_5 are earlier than the times TR_1-TR_5, line data L0_OUT-L4_OUT of the output signal OUT are line data L0_F2-L4_F2 of the frame F2. However, the frequency of the reading timing sequence signal RTSS is faster than that of the writing timing sequence signal WTSS in this example and the time TR_6 becomes earlier than the time TW_6. In other words, the line data L5_OUT and the following line data of the output signal OUT are the line L5_F1 and the corresponding line data of the frame F1. The frame tearing issue appears if the reading timing sequence signal RTSS is not adaptively adjusted.

Via the self-refreshing module 108, the reading timing sequence signal RTSS can be adaptively adjusted according to the writing timing sequence signal WTSS. Since the times TR_1 and TR_2 of reading the line data L0_FS of the frame FS are after the times of finishing writing the line data L0_F2 and L1_F2 of the frame F2 to be the line data L0_FS of the frame FS, the times TR_1 and TR_2 remains the same. At the time TR_3, the comparing unit 116 indicates that the line conflict occurs at the line data L2_FS (i.e. the line data L2_FS is under the writing process and reading process simultaneously) to the display timing generating module 106 via the line conflict signal LCS. The display timing generating module 106 therefore stops generating the signal of instructing reading the line data L2_FS until the time of finishing writing the line data L2_F2 to the storage module 102 (i.e. delays the time TR_3 to be the time TR_3' shown in FIG. 3B), and so on. As a result, the times of accessing the line data of the self-refresh frame FS (e.g. the times TR_1, TR_2 and TR_3'-TR_6' in FIG. 3B) are always after those of finishing writing the line data of the latest frame (e.g. the frame F2 in this example) to the storage module 102. The frame tearing issue therefore can be avoided.

Please note that, since the line data of the self-refresh frame FS stored in the storage module 102 can be appropriately read and wrote via the self-refreshing module 108, the minimum size of the storage module 102 equals the size of a frame of the video data signal VDS. In other words, the size required by the storage module 102 can be minimized to that of single frame of the video data signal VDS and the cost of the display system 10 therefore can be reduced.

Figure 4:
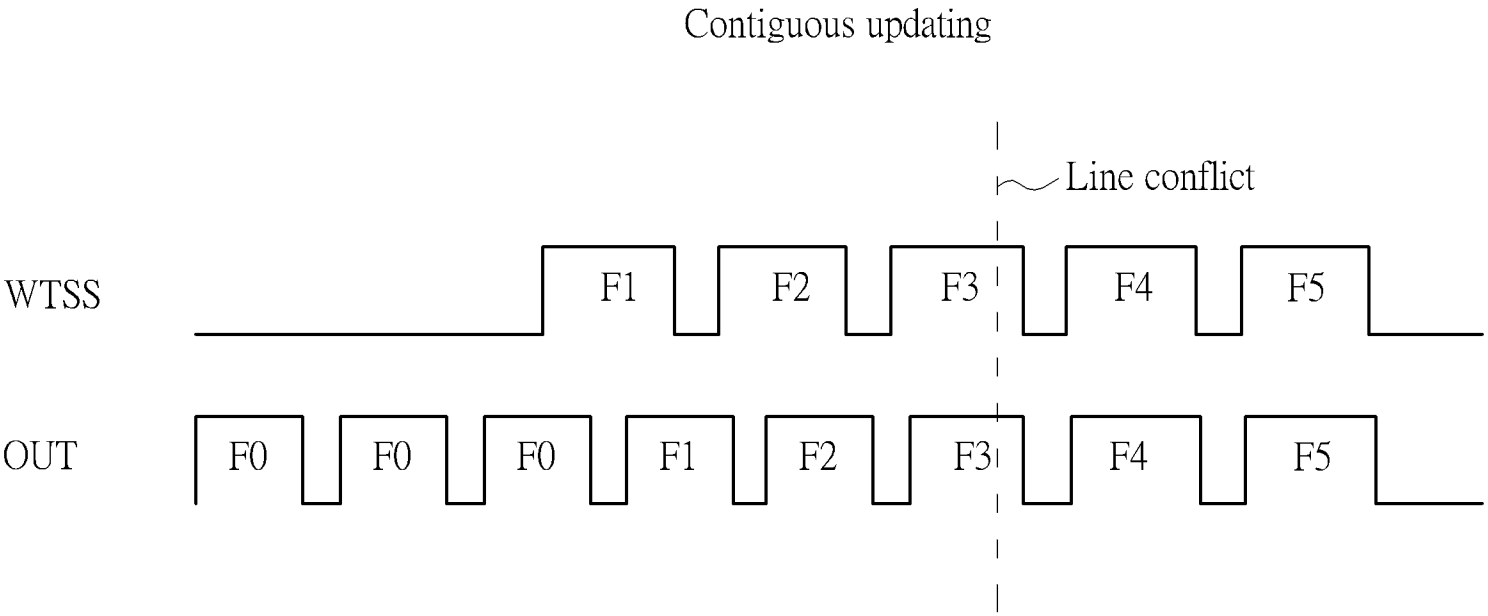
FIG. 4 is a timing diagram of related signals when the display system shown in FIG. 1 operates.

Furthermore, appreciating that the line data of the self-refresh frame FS stored in the storage module 102 can be appropriately read and wrote via the self-refreshing module 108, the display system 10 can work normally even if the video data signal VDS contiguously updates frames when the display system 10 operates in the self-refresh mode as show in FIG. 4. In this example, even if the line conflict occurs when updating the frame F3 to the storage module 102, the frame tearing issue also can be avoided according to the present invention. Moreover, the function of partial frame update defined in the embedded display port (eDP) specifications can be easily realized in the sink device SD of the present invention without the frame tearing issue.

Besides, the blanking detecting unit 110 may be omitted if the reading timing sequence signal RTSS is design to be much faster than the writing timing sequence signal WTSS when designing the displaying timing generating module 106. In such a condition, the power consumption of the display system 10 may be increased. Similarly, the comparing unit 118 may be omitted if the if the reading timing sequence signal RTSS is design to be slower than the writing timing sequence signal WTSS when designing the displaying timing generating module 106. However, the performance of the display system 10 may be downgraded.

Figure 5:
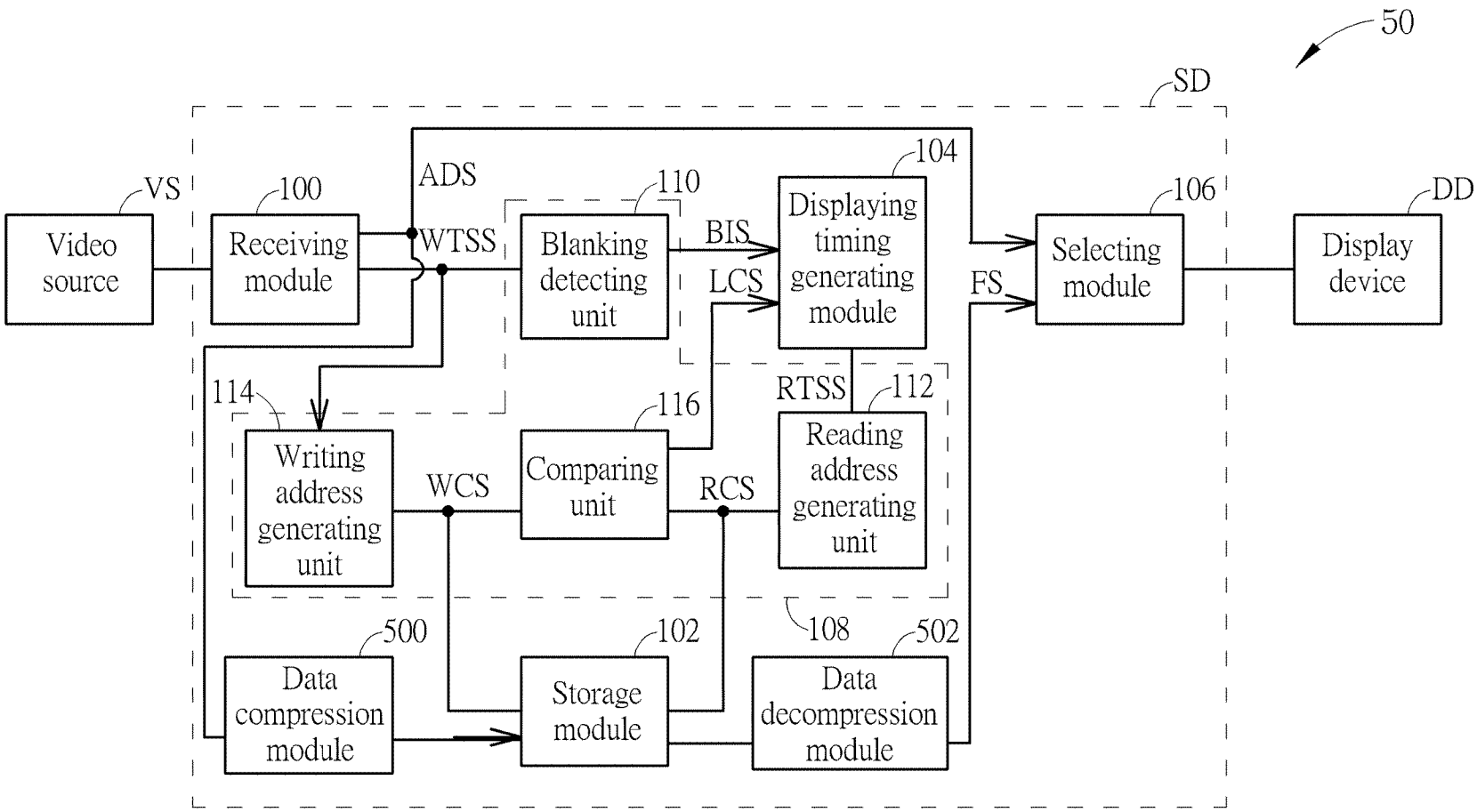
FIG. 5 is a schematic diagram of a display system according to an example of the present invention.

Via adjusting the reading timing sequence signal RTSS according to the writing timing sequence signal WTSS, the above embodiments avoid the frame tearing issue. According to different applications and design concepts, those with ordinary skill in the art may observe appropriate alternations and modifications. For example, please refer to FIG. 5, which is a schematic diagram of a display system 50 according to an example of the present invention. The architecture of the display system 50 is similarly to the display system 10 shown in FIG. 1, thus the components and signals with the similar functions use the same symbols. Different from the display system 10, the sink device SD of the display system 50 further comprises a data compression module 500 and a data decompression module 502. The data compression module 500 is coupled to the receiving module 100 and the storage module 102 for compressing the frames of the video data signal VDS and storing the compressed frame to the storage module 102. The data decompression module 502 is coupled to the storage module 102 and the selecting module 106 for decompressing the self-refresh frame FS accessed from the storage module 102 and outputting the decompressed self-refresh frame FS to the selecting module 106. In such a condition, the size of the storage module 102 can be further decreased.

Figure 6:
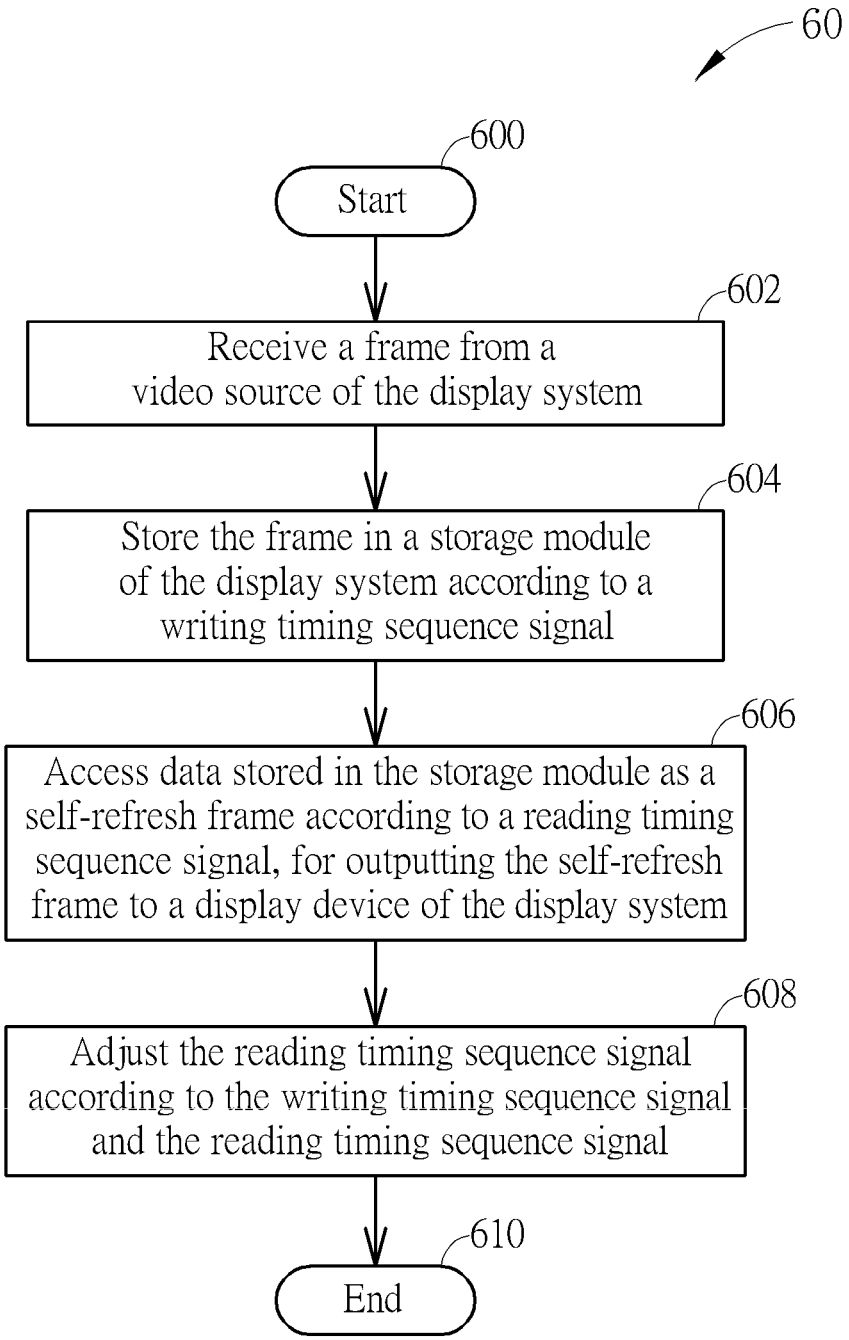
FIG. 6 is a flow chart of a self-refresh control method according to an example of the present invention.

The method of the self-refreshing module 108 adjusting the reading timing sequence signal RTSS according to the reading timing sequence signal WTSS in the self-refresh mode can be summarized into a self-refresh control method 60 as shown in FIG. 6. The self-refresh control method 60 can be utilized in a display system operating in a self-refresh mode and comprises the following steps:

Step 600: Start.

Step 602: Receive a frame from a video source of the display system.

Step 604: Store the frame in a storage module of the display system according to a writing timing sequence signal.

Step 606: Access data stored in the storage module as a self-refresh frame according to a reading timing sequence signal, for outputting the self-refresh frame to a display device of the display system.

Step 608: Adjust the reading timing sequence signal according to the writing timing sequence signal and the reading timing sequence signal.

Step 610: End.

According to the self-refresh control method 60, the display system receives a first frame from a video source of the display system and stores the first frame to a storage module of the display system according to a writing timing sequence signal when the display system operates in the self-refresh mode. At the same time, the data stored in the storage module are accessed to be a self-refresh frame according to a reading timing sequence signal, wherein the self-refresh frame is outputted to a display device of the display system and displayed by the display device when the display system operates in the self-refresh mode. The reading timing sequence signal is adjusted according to the writing timing sequence signal for avoiding the frame tearing issue. For example, the blanking intervals of the reading timing sequence signal may be adjusted to be equaled to the least blanking interval of the writing timing sequence signal, wherein the blanking interval of the writing timing sequence signal is the interval between times of writing data of adjacent lines of the frame. In another example, the reading timing sequence signal may be adjusted to stop accessing data from the storage module when detecting when the writing control signal and the reading control signal indicate the same data address in the storage device at the same time (i.e. the line conflict occurs). In still another example, the method of adjusting the blanking intervals of the reading timing sequence signal to be equaled to the least blanking interval of the writing timing sequence signal and the method of adjusting the reading timing sequence signal to stop accessing data from the storage module when the line conflict occurs are implemented simultaneously. The detailed operations of the self-refresh control method 60 can be referred to the above and are not narrated herein for brevity.

Figure 7:
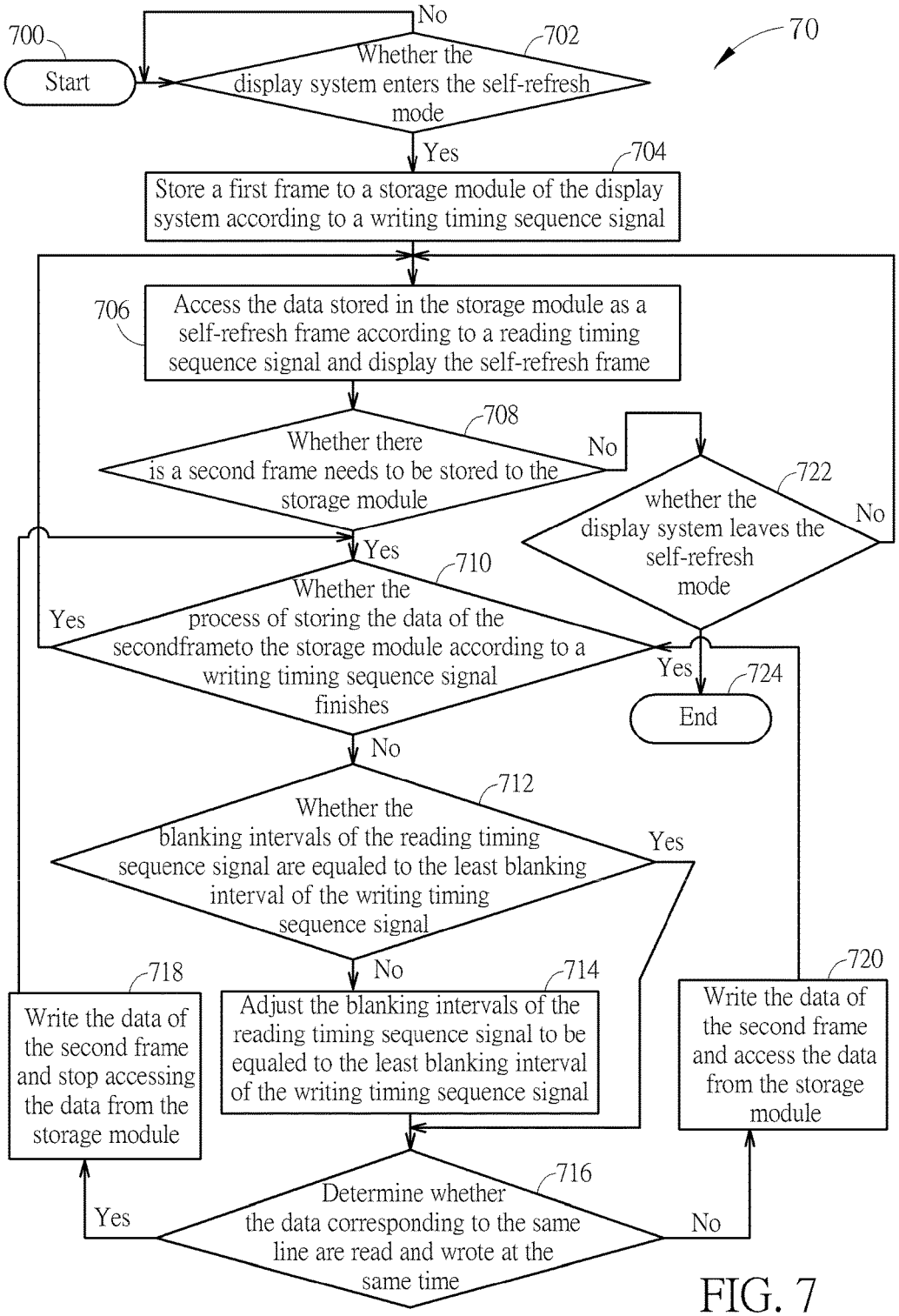
FIG. 7 is a flow chart of a self-refresh control method 70 according to another example of the present invention

Please refer to FIG. 7, which is a flow chart of a self-refresh control method 70 according to an example of the present invention, wherein the self-refresh control method 70 is a realization of the self-refresh control method 60. The self-refresh control method 70 is utilized in a display system with a self-refresh mode and comprises the following steps:

Step 700: Start.

Step 702: Determine whether the display system enters the self-refresh mode. If yes, perform step 704; otherwise, perform step 702.

Step 704: Store a first frame to a storage module of the display system according to a writing timing sequence signal.

Step 706: Access the data stored in the storage module as a self-refresh frame according to a reading timing sequence signal and display the self-refresh frame.

Step 708: Determine whether there is a second frame needs to be stored to the storage module. If yes, perform step 710; otherwise, perform step 722.

Step 710: Determine whether the process of storing the data of the second frame to the storage module according to the writing timing sequence signal finishes. If yes, perform step 706; otherwise, perform step 712.

Step 712: Determine whether the blanking intervals of the reading timing sequence signal are equaled to the least blanking interval of the writing timing sequence signal. If yes, perform step 716; otherwise, perform step 714.

Step 714: Adjust the blanking intervals of the reading timing sequence signal to be equaled to the least blanking interval of the writing timing sequence signal.

Step 716: Determine whether the data corresponding to the same line are read and wrote at the same time. If yes, perform step 718; otherwise, perform step 720.

Step 718: Write the data of the second frame and stop accessing the data from the storage module.

Step 720: Write the data of the second frame and access the data from the storage module.

Step 722: Determine whether the display system leaves the self-refresh mode. If yes, perform step 724; otherwise, perform step 706.

Step 724: End.

According to the self-refresh control method 70, the data of the self-refresh frame can be appropriately wrote and read at the same time. The size of storage module can be minimized to that of a single frame and the cost of the display system can be reduced. The detailed operations of the self-refresh control method 70 can be referred to the above and are not described herein for brevity.

To sum up, the above examples avoid the frame tearing issue via adjusting the timing of accessing data of the self-refresh frame according to the timing of updating the self-refresh frame. The size of the storage module used for storing the self-refresh frame can be minimized to be the size of a frame. Moreover, the functions of contiguously updating the self-refresh frame and partial frame update can be easily realized in the above example without the frame tearing issue.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A sink device for a display system, comprising:

a selecting module, for selecting one of a video data signal and a self-refresh frame to a display device of the display system;

a receiving module, for receiving the video data signal from a video source of the display system, outputting the video data signal to the selecting module and generating a writing timing sequence signal according to the video data signal;

a storage module, for storing a frame of the video data signal as the self-refresh frame and outputting the self-refresh frame to the selecting module according to a reading control signal;

a displaying timing generating module, for generating a reading timing sequence signal corresponding to the reading control signal and adjusting the reading timing sequence signal according to a blanking indicating signal and a line conflict signal; and a self-refreshing module, for generating the writing control signal and the reading control signal according to the writing timing sequence signal and the reading timing sequence signal, adjusting the reading timing sequence signal according to the writing timing sequence signal and the reading timing sequence signal via the blanking indicating signal and the line conflict signal.

2. The sink device of claim 1, wherein the self-refreshing module comprises:

a blanking detecting unit, for detecting a writing interval between times of writing data of adjacent lines of the frame according to the writing timing sequence, comparing the writing interval with a minimum interval; and storing the writing interval as the minimum interval and instructing the displaying timing generating module to adjust reading intervals between times of accessing data of adjacent lines of the self-refresh frame to be equaled the minimum interval via the blanking indication signal when the writing interval is smaller than the minimum interval.

3. The sink device of claim 1, wherein the self-refreshing module comprises:

a reading address generating unit, for generating a writing control signal according to the writing timing sequence signal;

a writing address generating unit, for generating a reading control signal according to the reading timing sequence signal; and a comparing unit, for comparing the writing control signal and the reading control signal and instructing the displaying timing generating module to stop reading the data of the self-refresh frame when the writing control signal and the reading control signal indicate the same line of the self-refresh frame simultaneously.

4. The sink device of claim 1, further comprising:

a compressing module, coupled between the receiving module and the storage module for compressing the frame, generating a compressed frame and storing the compressed frame to the storage module; and a decompressing module, coupled between the storage module and the selecting module for accessing the compressed frame stored in the storage module, decompressing the frame compressed frame as the self-refresh frame and outputting the self-refresh frame to the selecting module.

5. The sink device of claim 1, wherein the size of the storage module equals the size of the frame of the video data signal.

6. A display system, comprising:

a video source, for generating a video data signal;

a display device, for displaying an output signal;

a sink device, comprising:

a selecting module, for selecting one of a video data signal and a self-refresh frame as the output signal;

a receiving module, for receiving the video data signal, outputting the video data signal to the selecting module and generating a writing timing sequence signal according to the video data signal;

a storage module, for storing a frame of the video data signal as the self-refresh frame and outputting the self-refresh frame to the selecting module according to a reading control signal;

a displaying timing generating module, for generating a reading timing sequence signal corresponding to the reading control signal and adjusting the reading timing sequence signal according to a blanking indicating signal and a line conflict signal; and a self-refreshing module, for generating the writing control signal and the reading control signal according to the writing timing sequence signal and the reading timing sequence signal, adjusting the reading timing sequence signal according to the writing timing sequence signal and the reading timing sequence signal via the blanking indicating signal and the line conflict signal.

7. The display system of claim 6, wherein the self-refreshing module comprises:

a blanking detecting unit, for detecting a writing interval between times of writing data of adjacent lines of the frame according to the writing timing sequence, comparing the writing interval with a minimum interval; and storing the writing interval as the minimum interval and instructing the displaying timing generating module to adjust reading intervals between times of accessing data of adjacent lines of the self-refresh frame to be equaled the minimum interval via the blanking indication signal when the writing interval is smaller than the minimum interval.

8. The display system of claim 6, wherein the self-refreshing module comprises:

a reading address generating unit, for generating a writing control signal according to the writing timing sequence signal;

a writing address generating unit, for generating a reading control signal according to the reading timing sequence signal; and a comparing unit, for comparing the writing control signal and the reading control signal and instructing the displaying timing generating module to stop reading the data of the self-refresh frame when the writing control signal and the reading control signal indicate the same line of the self-refresh frame simultaneously.

9. The display system of claim 6, the sink device further comprises:

a compressing module, coupled between the receiving module and the storage module for compressing the frame, generating a compressed frame and storing the compressed frame to the storage module; and a decompressing module, coupled between the storage module and the selecting module for accessing the compressed frame stored in the storage module, decompressing the frame compressed frame as the self-refresh frame and outputting the self-refresh frame to the selecting module.

10. The display system of claim 6, wherein the size of the storage module equals the size of the frame of the video data signal.

* * * * *